US005348087A

United States Patent [19]

Williamson, Jr.

[11] Patent Number: 5,348,087

[45] Date of Patent: Sep. 20, 1994

[54] FULL BORE LOCK SYSTEM

[75] Inventor: Jimmie R. Williamson, Jr., Carrollton, Tex.

[73] Assignee: Halliburton Company, Houston, Tex.

[21] Appl. No.: 933,668

[22] Filed: Aug. 24, 1992

[51] Int. Cl.[5] ..... E21B 23/00

[52] U.S. Cl. ..... 166/115; 166/217; 166/237

[58] Field of Search ..... 166/115, 123, 134, 214, 166/217, 237, 242

[56] References Cited

U.S. PATENT DOCUMENTS

| | | | |
|---|---|---|---|
| Re. 26,319 | 12/1967 | Tamplen | 166/115 |
| 2,518,795 | 8/1950 | Knox | 166/224 X |
| 3,032,113 | 5/1962 | Dollison | 166/115 X |
| 3,036,637 | 5/1962 | Dollison | 166/217 X |
| 3,863,715 | 2/1975 | Yonker | 166/217 |
| 4,164,977 | 8/1979 | Arendt et al. | 166/125 |
| 4,254,829 | 3/1981 | Watkins | 166/214 X |
| 4,378,839 | 4/1983 | Fisher, Jr. | 166/217 |
| 4,396,061 | 8/1983 | Tamplen et al. | 166/217 |
| 4,437,522 | 3/1984 | Krause, Jr. et al. | 166/237 X |
| 4,540,048 | 9/1985 | Gazda | 166/214 |
| 4,562,889 | 1/1986 | Braddick | 166/217 X |
| 4,576,236 | 3/1986 | Stout et al. | 166/115 X |
| 4,595,054 | 6/1986 | Schroeder | 166/217 |
| 4,944,345 | 7/1990 | Mashaw, Jr. | 166/206 |
| 4,997,038 | 3/1991 | Welch | 166/214 |
| 5,082,061 | 1/1992 | Dollison | 166/378 |

*Primary Examiner*—Hoang C. Dang

*Attorney, Agent, or Firm*—Tracy W. Druce; Ronald O. Cox

[57] ABSTRACT

A locking system which includes landing nipples connectable in a well flow conduit and a lock mandrel to which well flow control devices are connectable. The landing nipples have an unrestricted full bore flow passage with profiled locking and locating recesses having no square shoulders in the flow passage The lock mandrel may be lowered through full bore landing nipples and operated to automatically locate in the full bore landing nipple in which the lock mandrel is to be operated to lock and expand a seal system to sealingly engage the landing nipple. The lock mandrel employs locking keys having no square shoulders. The automatic locator device has locating keys having no square shoulders, which position the lock mandrel in the landing nipple. After operating, the lock mandrel is releasably retained locked and sealed in the landing nipple. The automatic locator device may be operated to disengage the landing nipple and permit the lock mandrel to be unlocked and seal system contract for retrieval from the landing nipple.

12 Claims, 6 Drawing Sheets

FULL BORE LOCK SYSTEM

BACKGROUND (1) Field

This invention pertains to locking systems useful to position flow control devices in well flow conduits.

(2) Information

A number of locking systems have been developed which employ landing nipples spaced apart in well flow conduits and lock mandrels, with flow controls connected, which may be operated to locate, lock and seal in a selected one of the landing nipples. The landing nipples used in existing systems either contain a restriction or a "square shoulder" to enable selection and location of a particular landing nipple in a well conduit in which the lock mandrel is to be operated to lock and seal. A restriction in a landing nipple undesirably reduces the through flow passage area and creates a shoulder on which a lock mandrel may locate. A very limited number of restricted bore landing nipples can be utilized in a well flow conduit. If the landing nipple is "full bore" and not restricted, it usually has internal grooving known as profiled recesses and in the recesses is at least one "square shoulder" on which the lock mandrel may locate. A square shoulder is created by a surface perpendicular to and intersecting the longitudinal flow passage through a landing nipple. Lock mandrels and well tools moved downwardly or upwardly through landing nipples often hang on square shoulders and square shoulders create flow turbulence that possibly aids undesirable deposition of hard scale in recesses.

SUMMARY OF THE INVENTION

The locking system of this invention provides a full bore landing nipple having an unrestricted through flow passage equal in diameter to the internal diameter of the well flow conductor. Profiled locking and locating recesses in the landing nipple contain no square shoulders and an unlimited number of full bore landing nipples may be installed in a well flow conduit. The lock mandrel contains a unique locating device having keys which are engageable in landing nipple locating recesses. The locating device may be operated to select, locate and engage the locating recesses in any one of a great number of full bore landing nipples in which the lock mandrel is to be operated to lock and seal. The keys on the locating device have no square shoulders and the locating device may be operated to disengage locating recesses for retrieval of the lock mandrel from a full bore landing nipple to surface.

An object of this invention is to provide a locking system for well flow controls wherein the landing nipple is unrestricted and full bore and has the same minimum inside diameter as the well flow conduit into which it is connected.

An object of this invention is to provide a locking system wherein the landing nipple contains internal profiled recesses which have no square shoulders.

Another object of the present invention is to provide a locking system which utilizes a locking mandrel to which a number of different flow controls may be connected.

Another object of the present invention is to provide a locking system in which as many identical landing nipples as required may be connected in a well flow conduit.

Also an object of the present invention is to provide a lock mandrel which may be operated to selectively locate, lock and seal in any one of a number of compatible landing nipples in a well flow conduit.

Also an object of this invention is to provide a lock mandrel having a locating device with no square shoulders which will automatically engage recesses in a compatible landing nipple and be disengaged from the landing nipple by a predetermined pull force on the lock mandrel.

DESCRIPTION OF THE PREFERRED EMBODIMENT

Figure 1A:
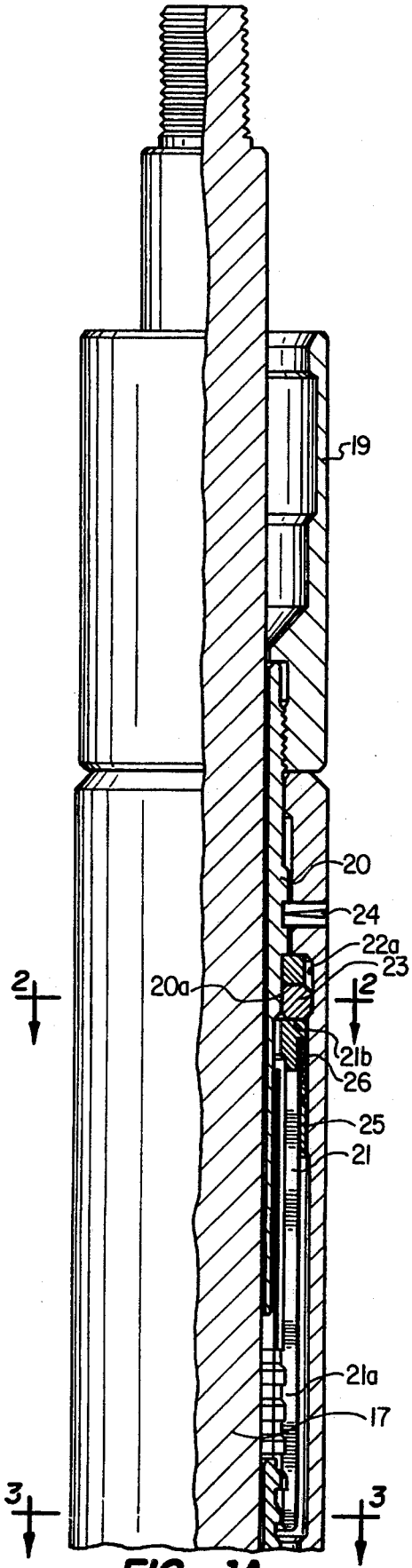
FIGS. 1A, 1B and 1C are a drawing in elevation and half section of the invention system showing the lock mandrel with attached flow control located in a full bore landing nipple.
Figure 1B:
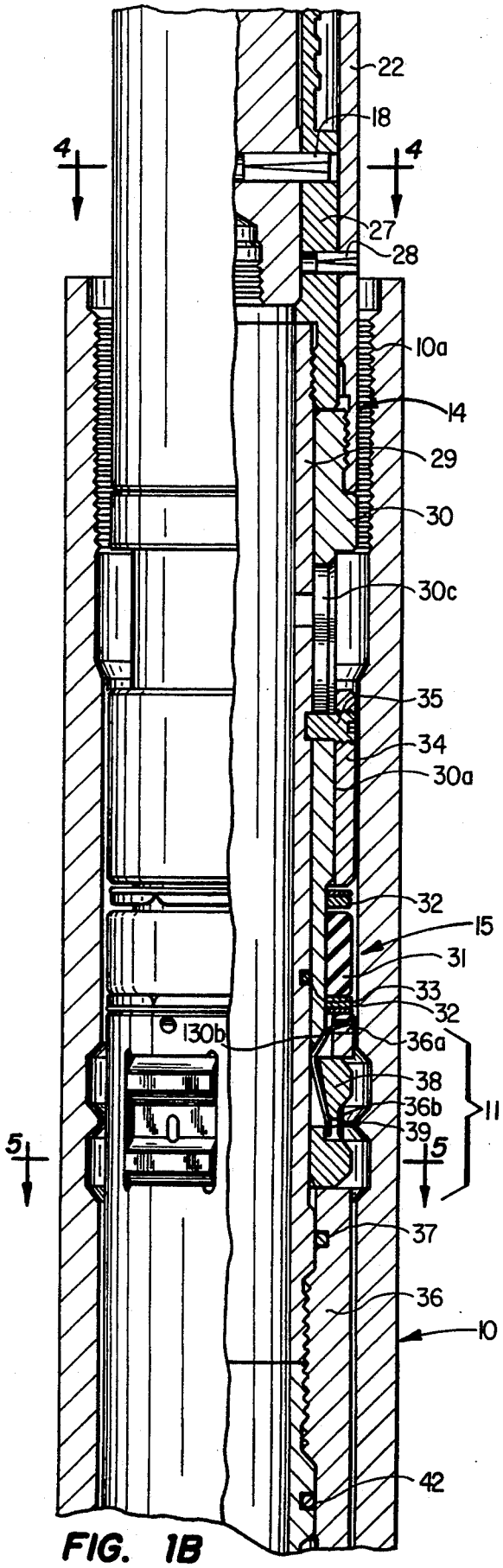
Figure 1C:
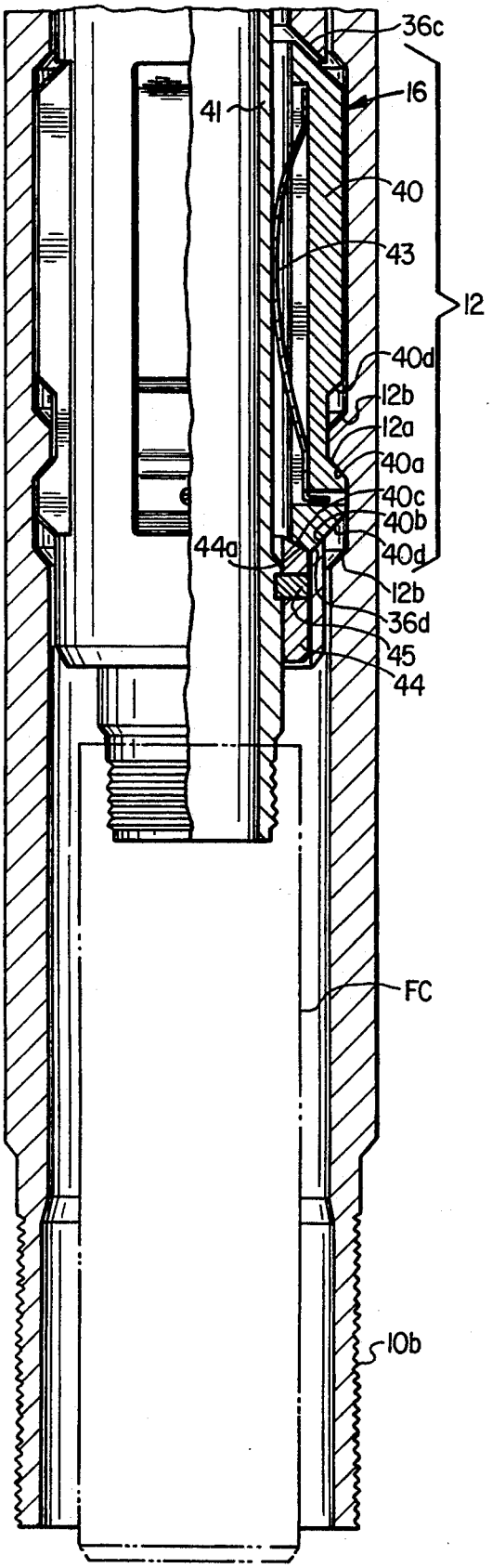
Figure 4:
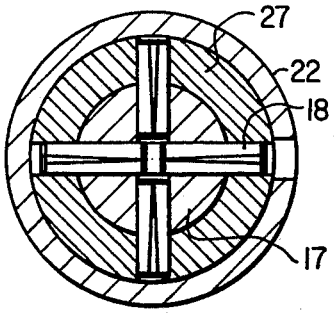
FIG. 4 is another cross sectional drawing along line 4—4 in FIG. 1.

Shown in FIGS. 1A, 1B and 1C is a full bore landing nipple 10, having connectors at **10*a* and 10*b* for connection into a well flow conduit. The landing nipple includes profiled locking recesses 11 and profiled locator recesses 12 having angular surfaces 12*a* and 12*b*. Any number of these landing nipples may be spaced apart and connected in a well flow conduit as it is installed in a well. A flow control FC has been connected to lock mandrel assembly 14. The lock mandrel includes a seal system 15 and a locator 16 has been releasably attached to a running tool adapter 17 by frangible pins 18 (see also FIG. 4**). The running tool adapter has been connected to a running tool (not shown) for lowering the lock mandrel downwardly in the well conduit to locate, seal and lock in a selected full bore landing nipple.

Figure 3:
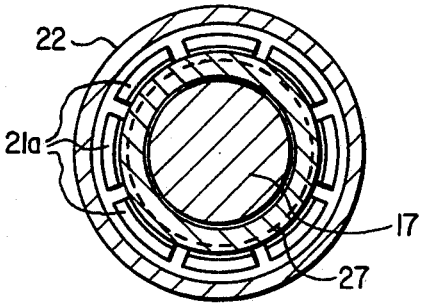
FIG. 3 is the drawing of a cross section along line 3—3 in FIG. 1.
Figure 2:
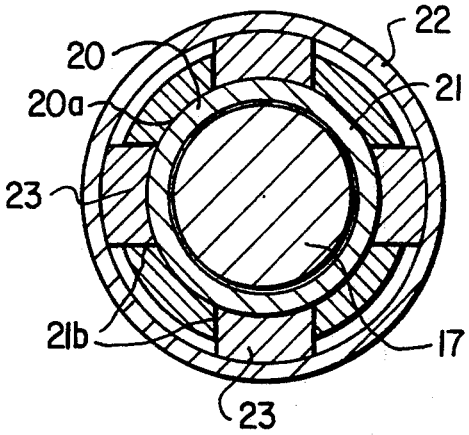
FIG. 2 is a cross sectional drawing along line 2—2 in Fig. 1.
Figure 9:
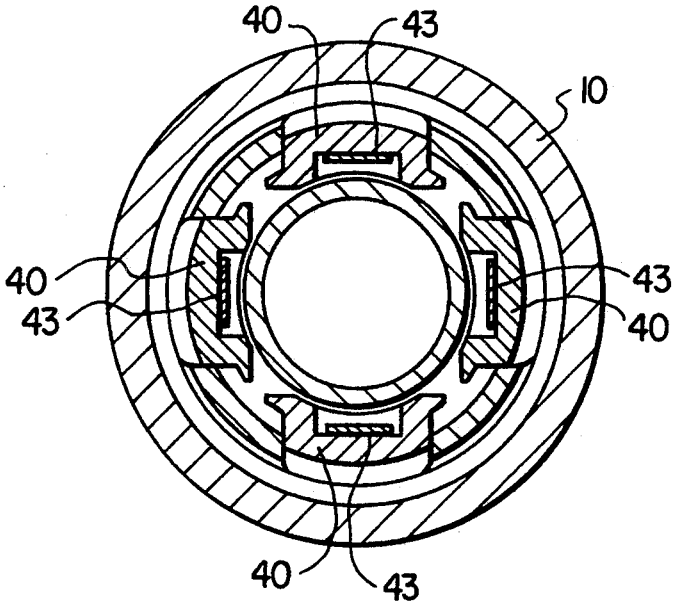
FIG. 9 is a drawing in cross Section along line 9—9 in FIG. 8.

The lock mandrel assembly includes a fishing neck 19 connected to an expander 20, which is slidably mounted around the run tool adapter and has an expanding diameter **20*a*. A ratchet collet 21 having flexible internally grooved fingers 21*a* is positioned in housing 22 (see also FIG. 3). The collet has a number of openings 21*b* in which radially moveable lugs 23 are mounted as also shown in FIG. 2. Lug expander 20 is releasably positioned in the housing by pins 24 and props the lugs into engagement in housing groove 22*a*, releasably connecting the collet to the housing. A lock ring 25 around the collet is positioned upwardly compressing spring 26 as the collet fingers are held "flared" (slightly tapered downwardly and outwardly) because there is no groove at the lower end of collet fingers 21*a*. The ratchet mandrel 27 has external grooves engageable with the collet finger internal grooves and is releasably positioned in the housing by pins 28**.

Figure 5:
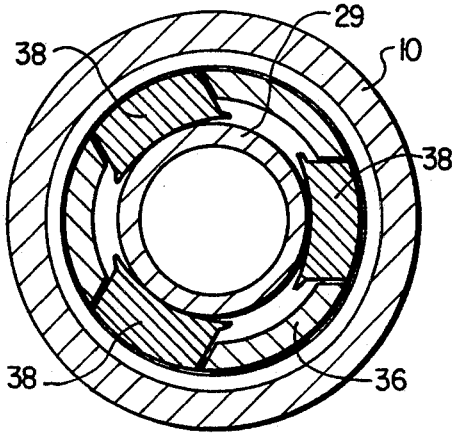
FIG. 5 is also a drawing of a cross section taken along line 5—5 in FIG. 1.

An upper mandrel 29 is connected to the lower end of the ratchet mandrel with key seal expander 30 slidably mounted around the upper mandrel and connected to the lower end of the housing. Seal system 15 is positioned around expander 30 and includes elastomer seal element 31 with expandable anti-extrusion rings 32. The upper and lower anti-extrusion rings 32 are preferably metal and each ring is spiral wound and has at least two coils. Expander 30 has a larger diameter 30*a*, a camming surface 30*b* and is sealed to mandrel 29 with seal 33. There are a number of slots 30*c* in the expander and a spacer ring 34 is positioned around expander larger diameter 30*a* by pin 35 through slots 30c and into mandrel 29. The lower anti-extrusion ring abuts the top of key retainer 36, which has a number of holes 36*a*, openings 36*b* and 36*c* and is connected and sealed to mandrel 29 with seal 37. Mounted for radial movement in openings 36*b* are profiled locking keys 38 (see FIG. 5). Each key is engageable in profiled landing nipple locking recesses 11 and has a leaf spring 39 anchored in holes 36*a* for moving keys 38 radially in openings 36*b*. Retractable profiled locating keys 40 are mounted for radial movement in key retainer openings 36*c*. These keys are profiled to engage profiled landing nipple recesses 12 and each has an angular surface 40*a* which engages a like angular surface 12*a* in landing nipple recesses 12. Each key retainer opening 36*c* has a lower camming surface 36*d* which engages a like camming surface on each key 40*b*. A lower mandrel 41 is connected and sealed to key retainer 36 with seal 42. Leaf springs 43 bias the locator keys outwardly to engage locating recesses 12. An angular surface 44a on support ring 44 engages a like angular surface on each key 40*c*. The support ring is releasably positioned on the lower mandrel by pins 45. Lock mandrel 14 has a through flow passage 46.

Figure 8A:
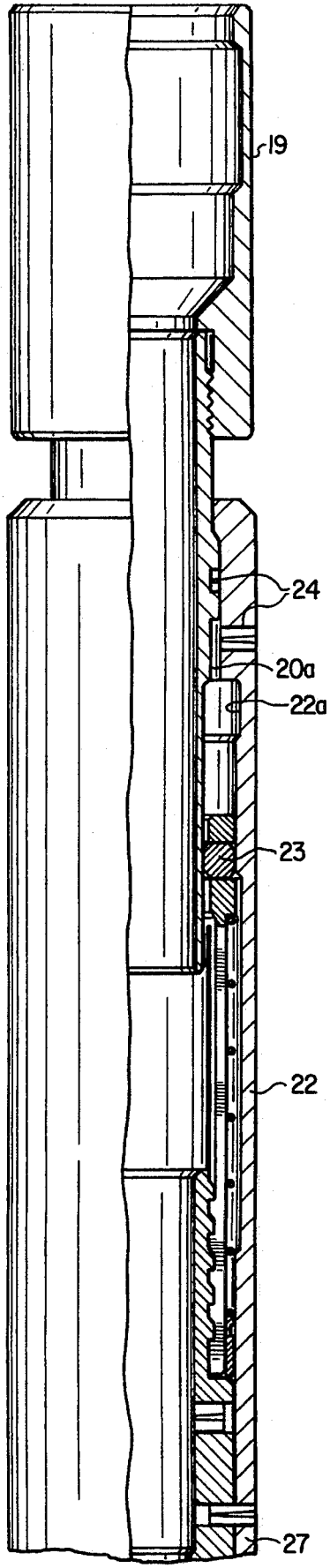
FIGS. 8A, 8B and 8C show the invention system in which the lock mandrel is disengaged and being retrieved from the landing nipple.
Figure 8B:
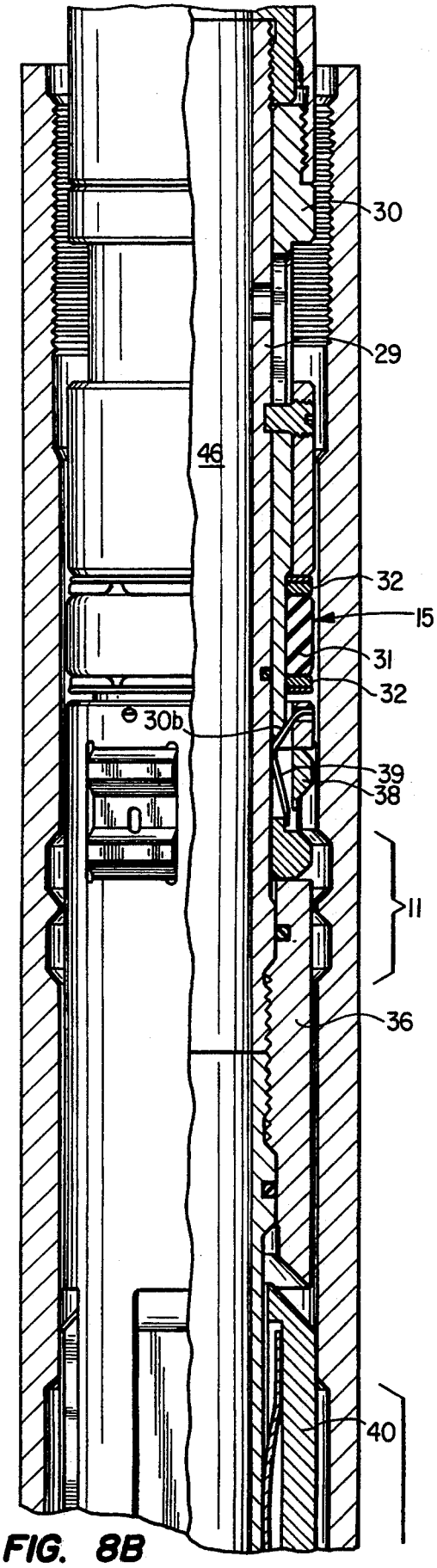
Figure 8C:
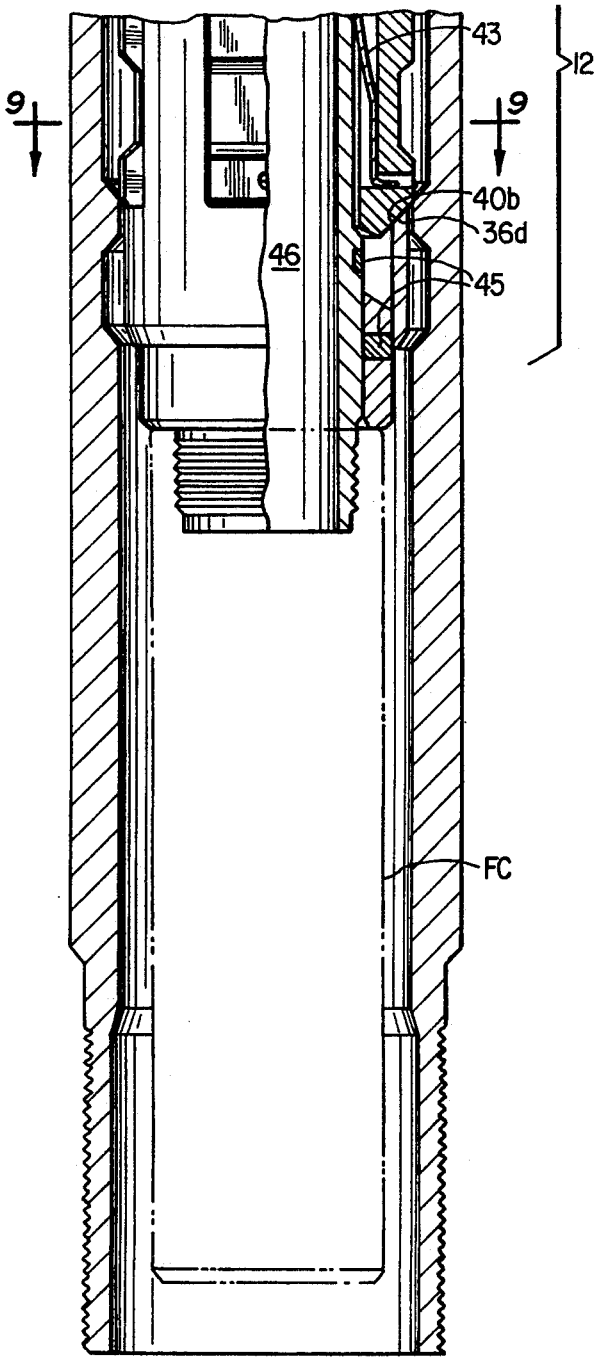

Any one of a number of flow controls FC, such as safety valves, injection valves, equalizing valves or other flow control devices may be connected on the lower end of mandrel 41 in lock mandrel 14. Run tool adapter 17 is connected to an appropriate running tool and mandrel 14 is positioned on the adapter with pins 18. The running tool with lock mandrel and flow control is lowered into the well conduit. The running tool is operated to cause the lock mandrel to locate, lock and seal in one of many full bore landing nipples 10 in the well conduit and control flow into mandrel flow passage 46 as shown in FIGS. 8A, 8B and 8C.

As the lock mandrel shown in FIGS. 1A, 1B and 1C is lowered down the well conduit and into a landing nipple 10, springs 43 expand locator keys 40 to engage landing nipple locating recesses 12 in each landing nipple. A small downward force on the running tool will engage locating key angular surfaces 40*b* with locating recesses angular surfaces 12*b*. More downward force on the running tool will now cam the locating keys inwardly and flatten springs 43 while disengaging the locating keys from nipple locating recesses and move the lock mandrel downwardly in the well conduit to the next lower landing nipple.

Figure 7:
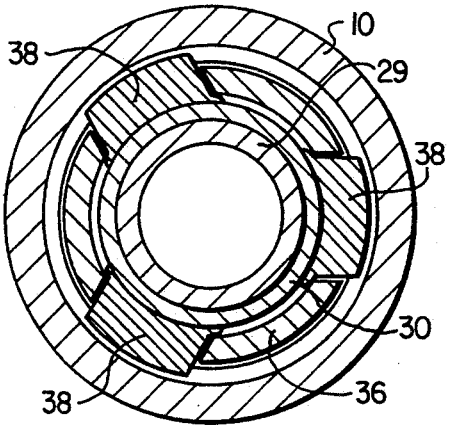
FIG. 7 is a cross sectional drawing along line 7—7 of FIG. 6.
Figure 6A:
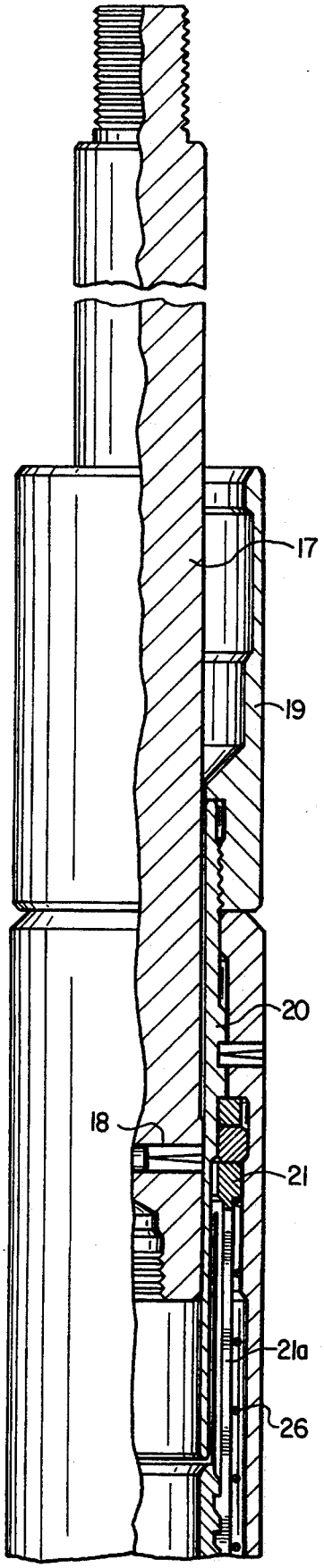
FIGS. 6A, 6B and 6C are a drawing in elevation and half section of the invention lock mandrel located, locked and sealed in the invention landing nipple.
Figure 6B:
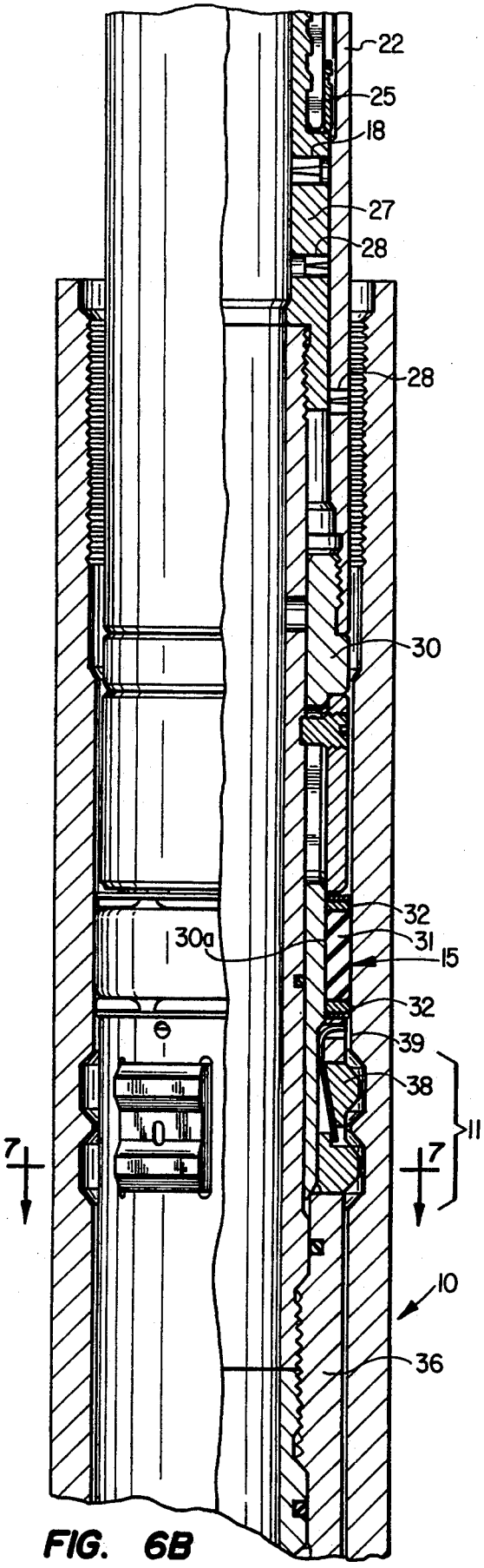
Figure 6C:
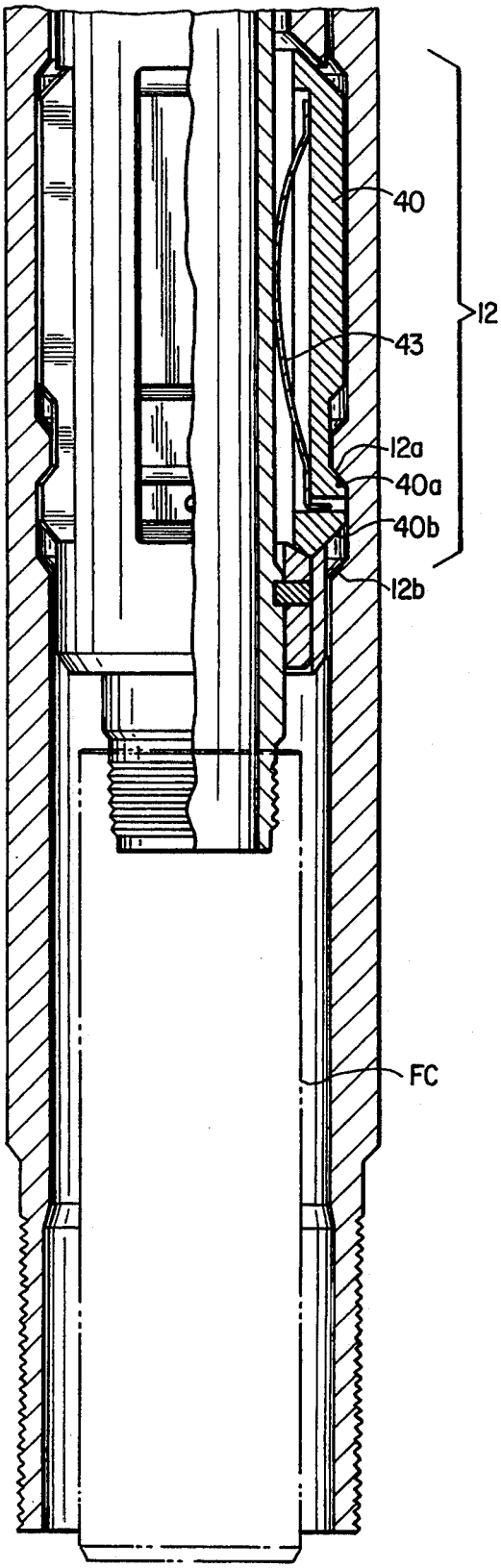

Forcing the lock mandrel through each landing nipple as it is lowered in the well conduit is continued until it is forced through and below the landing nipple in which the lock mandrel is to be locked and sealed. Now, the running tool is pulled upwardly until springs 43 push the locating keys into locating recesses 12 and key angular surface 40*a* engages locating recesses angular surface 12*a* and stops upward movement of the lock mandrel with locking keys 38 aligned to engage locking recess 11. Downward force from the running tool on fishing neck 19 shears pins 28 and moves the fishing neck, housing 22, ratchet collet 21 and expander 30 downwardly while grooves in collet fingers 21*a* "ratchet" downwardly over ratchet mandrel 27 grooves. Downward movement of the expander moves springs 39 and keys 38 outwardly to engage locking recesses 11 (see also FIG. 7) and expander larger diameter 30*a* inside seal system 15 expanding anti-extrusion rings 32 into contact with and seal 31 into sealing engagement with landing nipple 10. After collet 21 ratchets all the way down over mandrel 27 and the collet fingers move inwardly, spring 26 extends moving ring 25 down locking the collet in place on the mandrel—see FIGS. 6A, 6B and 6C. FIGS. 6A, 6B and 6C also show adapter 17 (which is connected to the running tool) has been moved upwardly shearing pins 18 for retrieval of the running tool and adapter back to surface. Removal of the running tool and adapter opens flow passage 46 (FIGS. 8A, 8B and 8C) completely for flow through flow control FC and lock mandrel 14 into the well conduit above.

To retrieve lock mandrel 14 and flow control FC from landing nipple 10, fishing neck 19 is engaged by an appropriate pulling tool which has been lowered through the well conduit. Sufficient upward force is applied to the pulling tool, fishing neck and lug expander 20 to shear pins 24 and move diameter 20*a* upwardly from inside lugs 23. Continued upward movement of expander 20 moves a smaller expander diameter inside lugs 23, permitting the lugs to disengage housing grooves 22*a* and key seal expander 30 to be moved upwardly when the upper shoulder on expander 20 contacts an upper shoulder in housing 22. Movement of camming surface 30*b* from inside springs 39 permits the springs to retract keys 38 from locking recesses 11 and movement of larger diameter 30*a* from inside seal system 15 permits anti-extrusion rings 32 and seal 31 to retract.

Continued upward pull on the fishing neck has sheared pins 45 and expander 30 upward movement on mandrel 29 has been stopped by contact with ratchet mandrel 27. After pins 45 shear, lifting upper mandrel 29 and key retainer 36 will slide key camming surfaces 36*d* upward along locating key camming surfaces 40*b* retracting and disengaging keys 40 from locating recesses 12 (see FIGS. 8A, 8B, 8C and 9). The lock mandrel with flow control may now be lifted and retrieved from the landing nipple back to surface.

What is claimed is:

1. A locking system comprising:

(a) a landing nipple connectable in a well flow conduit, said landing nipple having an unrestricted longitudinal flow passage therethrough and profiled locking and locating recesses in said flow passage, said flow passage having the same minimum inside diameter as the well conduit; and (b) a lock mandrel to which flow control devices are connectable, said lock mandrel including: an upper mandrel and a lower mandrel, means on said upper mandrel for locking in said nipple locking recesses, said locking means having profiled locking keys, sealing system means on said upper mandrel for expanding into sealing engagement with said landing nipple, locating means on said lower mandrel for automatically engaging said nipple locating recesses, said locating means having profiled locating keys and operable to disengage said nipple locating recesses, means therein for retaining said lock mandrel locked and sealed in said landing nipple including a ratchet mandrel engageable by a ratchet collet, and releasable means for releasing said lock mandrel to unlock and permit said sealing system means to contract.

2. The locking system of claim 1 wherein the lock mandrel locking means comprises:

(a) a key retainer having upper and lower openings therein, said key retainer connecting the upper and lower mandrels together;

(b) a profiled locking key having no square shoulders mounted for radial movement in each said upper opening;

(c) springs anchored in said key retainer for moving said keys radially outward; and (d) a key seal expander slidably mounted around said upper mandrel for moving said springs and holding said keys outward and engaged in the landing nipple locking recesses and expanding the sealing system means.

3. The locking system of claim 2 wherein the lock mandrel sealing system means comprises:

(a) an upper expandable anti-extrusion ring;

(b) an expandable elastomer seal;

(c) a lower expandable anti-extrusion ring; and (d) the key seal expander having a larger diameter thereon for expanding said anti-extrusion rings and seal.

4. The locking system of claim 3 wherein the lock mandrel seal system anti-extrusion rings are metal and are spiral wound having at least two coils.

5. The locking system of claim 2 wherein the lock mandrel locating means comprises:

(a) each key retainer lower opening having an inwardly and downwardly tapering camming surface along the lower side thereof;

(b) a profiled locating key having no square shoulders mounted for radial movement in each said opening, each said key having an outer downwardly and inwardly tapering camming surface engageable with said opening camming surface intersected by an inner downwardly and outwardly tapering angular surface;

(c) springs between the lower mandrel and said keys biasing said keys outwardly; and (d) means releasably supporting said locating keys.

6. The locking system of claim 5 wherein the means in the lock mandrel releasably supporting the locating keys comprises:

(a) a support ring positioned on the lower mandrel by a (b) shearable pin through said ring into said mandrel.

7. The locking system of claim 2 wherein the means for retaining the lock mandrel locked and sealed in the landing nipple comprises:

(a) a housing connected on the key seal expander;

(b) a ratchet mandrel having external grooves, said ratchet mandrel connected on the upper mandrel;

(c) a collet with a number of fingers, said fingers having internal grooves engageable with said ratchet mandrel external grooves;

(d) releasable means for positioning said collet in said housing; and (e) means for holding said collet engaged with said ratchet mandrel;

8. The locking system of claim 7 wherein the releasable means positioning the collet in the housing comprises:

(a) an internal groove in said housing;

(b) openings in said collet;

(c) a lug mounted for radial movement in each said collet opening;

(d) a lug expander slidably mounted and releasably positioned in said housing, said lug expander having a larger diameter for holding said lugs radially outward and engaged in said housing internal groove.

9. The locking system of claim 7 wherein the means for holding the collet engaged with the ratchet mandrel comprises:

(a) a spring around the collet fingers; and (b) a lock ring slidably mounted around said collet fingers.

10. A lock mandrel operable to releasably lock and sealingly engage a compatible landing nipple having an unrestricted flow passage therethrough, said lock mandrel comprising:

(a) upper and lower connected mandrels;

(b) releasable locator means on said lower mandrel for automatically engaging said landing nipple, said locator means operable to disengage said landing nipple;

(c) releasable locking means on said upper mandrel for locking said lock mandrel in said landing nipple;

(d) contractible seal system means on said upper mandrel for expanding and sealingly engaging said landing nipple; and (e) means for retaining said lock mandrel locked and sealed in said landing nipple including a ratchet mandrel engageable by a ratchet collet.

11. The lock mandrel of claim 10 further including releasable means for releasing said lock mandrel to unlock and permit said sealing system means to contract.

12. A locking system comprising:

(a) a landing nipple connectable in a well flow conduit, said landing nipple having an unrestricted longitudinal flow passage therethrough and profiled locking and locating recesses with no square shoulders in said flow passage; and (b) a lock mandrel to which flow control devices are connectable, said lock mandrel including:

an upper mandrel;

means on said upper mandrel for locking in said nipple locking recesses, said locking means having profiled locking keys with no square shoulders, said locking means including, a key retainer having upper and lower openings, said profiled locking keys mounted for radial movement in each said upper opening, springs anchored in said key retainer for moving said keys radially outward contractible sealing system means on said upper mandrel for expanding into sealing engagement with said landing nipple, said sealing system means including, an upper expandable anti-extrusion ring,
an expandable elastomer seal,
a lower expandable anti-extrusion ring,
a key seal expander slidably mounted around said upper mandrel for moving said springs and holding said keys outward and engaged in the landing nipple locking recesses and expanding the sealing system means,
said key seal expander having a larger diameter thereon for expanding said anti-extrusion rings and seal;
locating means for automatically engaging said nipple locating recesses, said locating means having profiled locating keys with no square shoulders and said locating means operable to disengage said nipple locating recesses, said locating means including,
a lower mandrel connected to said upper mandrel by said key retainer,
an inwardly and downwardly tapering camming surface along the lower side of each said lower key retainer opening,
a profiled locating key mounted for radial movement in each said lower opening, each said key having along its lower end an outer downwardly and inwardly tapering camming surface engageable with said lower opening camming surface intersected by an inner downwardly and outwardly tapering angular surface, springs between said lower mandrel and said locating keys biasing said keys outwardly; and
means releasably supporting said locating keys including, a support ring releasable positioned on said lower mandrel by a shearable pin through said ring into said mandrel;
means for retaining said lock mandrel locked and sealed in said landing nipple, and said means for retaining said lock mandrel locked and sealed including,
a housing connected on said key seal expander,
a ratchet mandrel having external grooves, said ratchet mandrel connected on said upper mandrel,
a collet having internal grooves engageable with said ratchet mandrel external grooves; and
releasable means for releasing said lock mandrel to unlock and permit said sealing system means to contract, said releasable means including,
an internal groove in said housing,
openings in said collet,
a lug mounted for radial movement in each said collet opening;
a lug expander slidably mounted and releasably positioned in said housing, said lug expander having a larger diameter for holding said lugs radially outward and engaged in said housing internal groove.

* * * * *